United States Patent [19]

Larrieu

[11] Patent Number: 4,944,123

[45] Date of Patent: Jul. 31, 1990

[54] CONSTRUCTION PROP BASE

[76] Inventor: David Larrieu, 1936 Novato Blvd., Novato, Calif. 94901

[21] Appl. No.: 379,619

[22] Filed: Jul. 14, 1989

[51] Int. Cl.[5] ..... E04G 21/26

[52] U.S. Cl. ..... 52/127.2; 52/720; 52/745; 248/351

[58] Field of Search ..... 52/146, 127.2, 720, 52/155, 700, 741, 745; 248/351, 357

[56] References Cited

U.S. PATENT DOCUMENTS

| | | | |
|---|---|---|---|
| Re. 21,905 | 9/1941 | Nielsen et al. | 52/127.2 |
| 73,346 | 1/1868 | Lamb | 248/351 |
| 299,529 | 6/1884 | England . | |
| 1,021,650 | 3/1912 | Worthington | 248/351 |
| 2,277,939 | 3/1942 | Thalhammer | 248/351 |
| 2,362,495 | 11/1944 | Mayberry . | |
| 3,574,981 | 4/1971 | Henschen . | |
| 3,648,421 | 3/1972 | Bjork | 52/127.2 |
| 3,883,117 | 5/1975 | Powell . | |
| 4,048,771 | 9/1977 | Thistlethwaite | 52/127.2 |
| 4,083,156 | 4/1978 | Tye . | |

*Primary Examiner*—David A. Scherbel

*Assistant Examiner*—Caroline D. Dennison

*Attorney, Agent, or Firm*—Fleit, Jacobson, Cohn, Price, Holman & Stern

[57] ABSTRACT

An elongated stiff but flexive and longitudinally bowable inclined push stick is provided including an upper end engageable with the top plate of a wall frame and equipped with subfloor surface engaging and penetrating teeth on its lower end. The upper end of push stick is engageable with the top plate of a first wall frame adjacent a second relatively angulated wall frame relative to which the first wall frame is anchored and the teeth on the lower end of the push stick are engaged with the subflooring. Thereafter, the longitudinal mid portion of the push stick has downward inclined pressure applied thereto toward the sole plate of the first wall frame while the upper end of the push stick is maintained in engagement with top plate of the first wall frame in order to slide the teeth of the lower end of the push stick along the subflooring until the first wall frame is vertically disposed after which the downward pressure on the longitudinal mid portion of the push stick may be released and inclined brace of the second wall frame may be secured in position.

3 Claims, 1 Drawing Sheet

FIG. 1
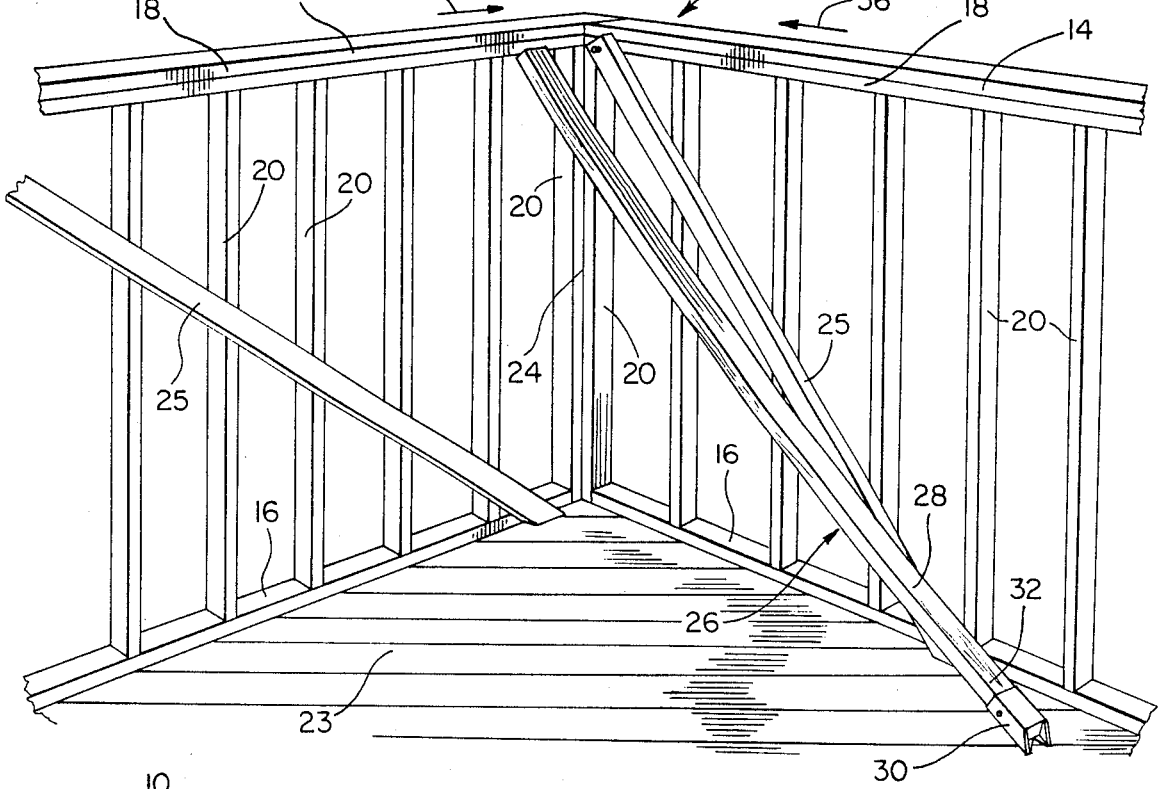
FIG. 2
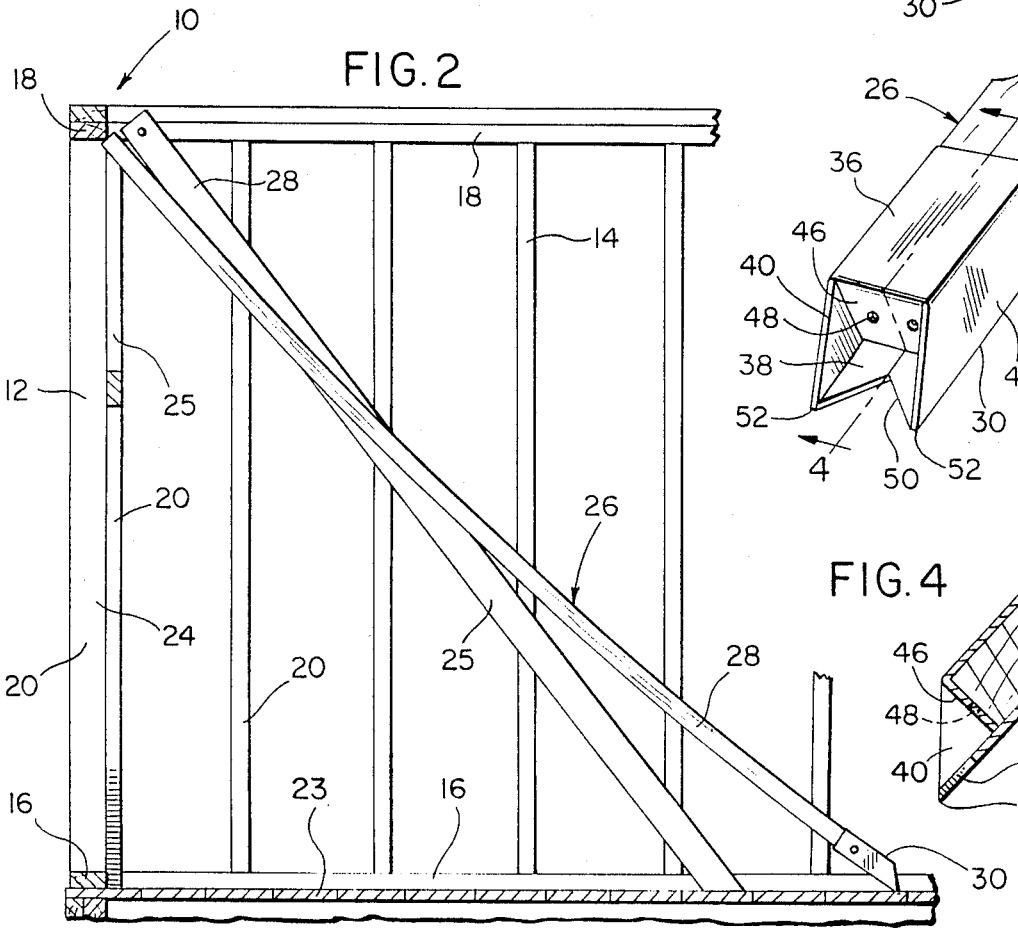
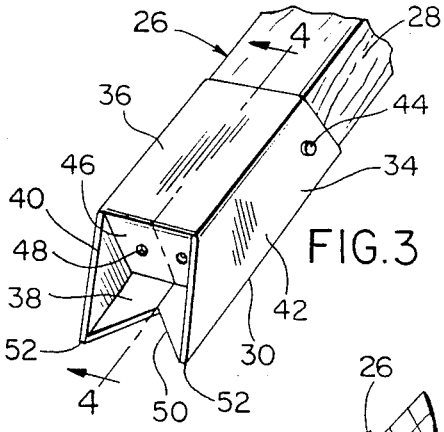
FIG. 3
FIG. 4
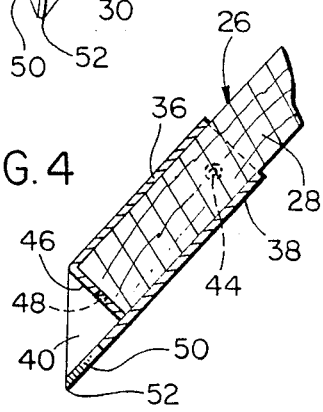

CONSTRUCTION PROP BASE

BACKGROUND OF THE INVENTION

1. Field of the Invention

This invention relates to a toothed base which may be telescoped over and secured to one end of a 2×4 and utilized as a prop for plumbing and lining (racking) wall frames.

The toothed equipped base end of the 2×4 is engaged with a subflooring surface spaced outward from a wall frame and the opposite end of the 2×4 is abutted against the top plate of a first wall frame closely adjacent to the end thereof anchored relative to a second wall frame disposed at an angle relative to the first wall frame, the prop being used to plumb the studs of the second wall frame and laterally plumb the first wall frame.

2. Description of Related Art

Various different forms of props and jacks including some of the general structural and operational features of the instant invention are disclosed in U.S. Pat. Nos. 299,529, 2,362,495, 3,574,981, 3,883,117, and 4,083,156. However, these previously known devices do not include the overall structural and operational features of the instant invention, nor are they used in the same manner in plumbing frame walls.

SUMMARY OF THE INVENTION

Plumbing a wall frame for building purpose refers to a adjusting wall frames to be vertically and horizontally square. Traditionally, the wall plumbing process begins after all walls of the first floor of a building structure are framed and the top plates are fastened. The top plates consist of two 2×4's stacked on one another and overlapped in the wall corners to tie the walls together.

To prevent lateral wall movement, temporary diagonal braces are strategically positioned within the outside corners and inside of adjoining wall frames with the upper ends of the diagonal braces anchored relative to the top plates and the lower ends of the braces disposed along the corresponding sole plates (to be subsequently secured thereto).

Thereafter, a series of push sticks are cut to different lengths and one set of corresponding ends of the push sticks are fastened to the subflooring and the other ends thereof are placed against and ride upon the top plates of the wall frames. This allows for wall adjustment of only a few inches as downward pressured is applied to the push stick.

A carpenters level is then placed vertically on a wall frame corner to determine wall frame lean and position as well as needed adjustment. Thereafter, a push stick is cut to fit the space between the top plate and the closest adjacent sole plate and is placed diagonally in the corner of the adjacent wall frame of the wall frame to be plumbed. As noted, the upper end of the push stick is placed into the corner against the top plate of the wall frame. The base end of the push stick is wedged against an opposite wall frame sole plate within reach of the push stick. If no sole plate is within reach, then the lower end must be nailed to the subflooring to provide support against which to push down on the push stick for the required leveraged movement.

The actual plumbing adjustment begins by putting downward pressure on the push stick to move the wall frame to a plumb position. The push stick must be placed on the inside lean of the wall frame as leverage can only be accomplished with downward pressure. As the top of the push stick moves downward off the top plate to accomplish wall frame adjustment; the push stick can be cut to length to further adjust the top plate. Therefore, plumbing one wall frame may require different length push sticks which must be specifically cut. A wall frame is pushed into plumb by pushing on the adjacent wall frame. There always is an inside corner on which to push, eliminating the need to push from the outside on a second story wall frame or from an unfavorable outside ground surface adjacent a first floor wall frame.

Once the wall frame is plumb, the bottom of the previously placed diagonal brace is nailed to the sole plate.

The above process requires cutting and nailing different length push sticks to accommodate the distance the top plate moves away from the sole plate as the wall frame moves to a plumb position. It also requires a minimum of two or three people.

Next, the wall frames are lined to conform the top plates with the outside corners of the wall frames. The purpose of lining is to keep opposite top plates parallel with each other to make sure that any out of line foundation is corrected at the top plate to allow for correct placing of the joists. This process involves stretching a line between the top of two plumb wall corners and adjusting the top plate parallel with the line. The top plates are adjusted using the same push stick method for plumbing the wall frames.

The instant invention eliminates the need to cut different length push sticks as its design allows a push stick to bite into the subflooring at any position which is on a angle to the wall frame being pushed. By repositioning the lower end of the push stick of the instant invention on the subflooring, it can provide unlimited wall frame adjustment, whereas the standard push stick provides only inches of adjustment. One work person can adjust, level and nail the diagonal brace in position once the wall frame is plumb.

The main object of this invention is to provide a prop base which may be telescoped over and secured to the lower end of an inclined 2×4 having its upper end abutted against a wall frame top plate closely adjacent an adjoining wall frame disposed at an angle relative to the first mentioned wall frame and with the prop base being provided with subflooring surface penetrating teeth, whereby a single length prop, capable of being longitudinally bowed maybe used and engaged with a wall frame for the purpose of plumbing an adjacent wall frame.

Another object of this invention is to provide a combined prop and prop base in accordance with the preceding object and which may be used by a single person to carry out wall frame plumbing operations.

Yet another important object of this invention is to provide a toothed base for an inclined 2×4 to be used as a wall frame push prop and with the base being of a size to be readily carried within a carpenters tool box.

Another object of this invention is to provide a frame wall push stick/brace to be used in wall frame plumbing operations and which enables a wall frame plumbing operation to be quickly carried out by a single person through the utilization of a novel method.

A final object of this invention to be specifically enumerated herein is to provide a wall frame push stick/-brace in accordance with the preceding objects and which will conform to conventional forms of manufacture, be of simple construction and easy to use so as to provide a device that will be economically feasible, long lasting, and relatively trouble free in operation.

These together with other objects and advantages which will becomes subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary perspective view of a building wall frame corner portion wherein adjacent ends of relatively angulated wall frames are relatively joined and each wall frame has a diagonal brace operatively associated therewith and a wall frame push stick/brace constructed in accordance with the present invention is operatively associated with one of the wall frames at the end thereof closely adjacent the other wall frame preparatory to wall frame plumbing operations;

FIG. 2 is an enlarged fragmentary vertical sectional view of the assemblage illustrated in FIG. 1 taken substantially upon a plane paralleling and spaced to the foreground of the right hand wall frame of FIG. 1;

FIG. 3 is an enlarged fragmentary perspective view of the lower subfloor surfacing engaging end of the push stick/prop of the instant invention;

FIG. 4 is a vertical sectional view taken substantially upon the plane indicated by the section line 4—4 of the FIG. 3.

DESCRIPTION OF THE PREFERRED EMBODIMENT

Referring now more specifically to the drawings the numeral 10 generally designates one corner portion of a building under construction. The corner portion 10 is defined by first and second wall frames 12 and 14 each including sole and top plates 16 and 18 interconnected by a plurality of laterally spaced apart vertical studs 20. The sole plates 16 are secured to a subflooring 23 in the usual manner and the adjacent ends of the wall frames 12 and 14 are joined by a conventional corner construction 24 including adjacent studs 20 of the wall frames 12 and 14 and two additional corner members (not shown) disposed in the outside corner defined by the adjacent studs 20 of the wall frames 12 and 14.

Each of the wall frames 12 and 14 further includes a diagonal brace 25 whose upper end is secured to the corresponding top plate 18 and whose lower end abutts the subflooring 23 immediately adjacent the inside of the corresponding sole plate 16.

The push stick/prop of the instant invention is referred to in general by the reference numeral 26 and includes a length of lumber such as a conventional 2×4 28 disposed in inclined position and having a base 30 telescoped over and secured to its lower end 32.

The base 30 incorporates a rectangular tubular member 34 having top and bottom wall 36 and 38 interconnected by opposite side walls 42. The rectangular tubular member 34 is snugly, telescopingly engaged over the lower end 32 of the 2×4 and secured thereto through the utilization of opposite side nails 44 secured through the side walls 40 and 42 and into the 2×4. In addition, the lower terminal end of the top wall 36 is cut from the adjacent portions of the side walls 40 and 42 and is inwardly bent at 90° relative to the top wall 36 in order to form an end wall 46, a pair of holes 48 being formed through the end wall 46 to provide for drainage. The lower end of the bottom wall 38 projects below the end wall 46 and has a central V-shaped notch 50 formed therein. Those portions of the bottom wall disposed on either side of the notch 50 coact with the adjacent portions of the side walls 40 and 42 to define a pair of opposite side teeth 52 which penetrate and bite into the subflooring 23. In addition, the upper end of the 2×4 is abutted against the top plate 18 of the first wall frame 12 closely adjacent the end thereof anchored relative to the second wall frame 14 (within four inches of the second wall frame).

Once the wall frames 12 and 14 have been erected and the diagonal braces have been positioned and their upper ends secured to the corresponding top plates 18, the push stick/brace 26 is positioned as illustrated in FIG. 1 against the top plate 18 of the wall frame 12. Then, in order to push the top plate 18 of the first wall frame 12 outwardly in order to shift the top plate 18 of the second wall 14 and the upper ends of the studs 20 in the direction of the arrow 56 in the FIG. 1, downward pressure is applied to the longitudinal mid portion of the 2×4 toward the sole plates 16 of the first wall frame 12 while the upper end of the 2×4 is maintained abutted against the top plate 18 of the wall frame 12. This causes the base 30 to slide across the subflooring 23 toward the sole plate 16 of the first wall frame 12 and the top plate 18 of the first wall frame 12 also to be shifted in the direction of the arrow 56. As the aforementioned downward pressure is applied to the longitudinal mid portion of the 2×4, the 2×4 is longitudinally bowed and when correct positioning of the top plates 18 of the wall frames 12 and 14 in direction of the arrow 56 has been accomplished, the downward pressure is released and the resiliency of the bowed 2×4 will retain the wall frames 12 and 14 in the adjusted positions thereof. At this point, the lower end of the diagonal brace 25 for the second wall frame 14 may be nailed to the corresponding sole plate 16. Thereafter, the push stick/prop 26 is removed and repositioned adjacent corner construction 24 in a plane closely adjacent and paralleling the first wall frame 12 with the upper end of the 2×4 engaged with the top plate of the wall frame 14. Then, the above mentioned steps are repeated in order to shift the top plates 18 in the direction of the arrow 58 to complete the plumbing operation of the wall frames 12 and 14.

It may thus be seen that a single work person equipped with the push stick/prop 26 and a carpenters level may properly plumb both wall frames 12 and 14. Of course, after adjustment of the top plates 12 in direction of the arrow 58 has been achieved, the lower end of the diagonal brace 25 of the wall frame 12 is nailed in position relative to the sole plate 16 of the wall frame 12.

Utilization of the push stick/prop 26 may be carried out through the utilization of only one 2×4 and attendant base 30. This not only represents considerable saving in 2×4's, but also frees other workmen for other building tasks since the above mentioned wall plumbing operations may be carried out by a single work person.

The foregoing is considered as illustrative only of principles of the invention. Further, since numerous modifications and change will readily occur to those skilled in the art, it is not desired to limit the invention to the exact construction and operation as shown and described, and, accordingly, all suitable modifications and equivalents may be resorted to, falling within the scope of the invention.

What is claimed as new is as follows:

1. An inclined wall framing top plate-to-subfloor push stick incorporating an elongated, stiff prop member having first and second upper and lower ends, said first end including endwise outwardly facing abutment surface means for abutting engagement with a first wall frame top plate adjacent one end thereof adjoining a second wall frame disposed at an angle relative to said first wall frame, said second end including subfloor surface engaging means for non-slip engagement with and penetration of a subfloor upper surface spaced from said first wall frame against slipping of said subfloor surface engaging means relatively to said subfloor away from said first wall frame, but enabling shifting of said subfloor surface engaging means over said subfloor upper surface toward said first wall frame and subsequent non-slip re-engagement with and penetration of said subfloor upper surface, said elongated, stiff prop member being somewhat flexive and including physical characteristics enabling said prop member to be longitudinally bowed in a first vertical plane containing said prop member, but resisting longitudinal bowing of said prop member in a second plane containing said prop member and disposed normal to said first plane, said subfloor surface engaging means including an end member telescoped over said second end and of said prop member, said end member comprising a rectangular tubular member telescoped over and secured to said second end and including an end wall abutted against the terminal end face of said second end, said end member including endwise outwardly projecting teeth extending outward beyond said end wall.

2. The push stick of claim 1 wherein said prop member comprises a wood 2×4.

3. The method of plumbing, both laterally and longitudinally, a pair of adjacent, mutually anchored and subfloor supported corner defining wall frames including lower sole and upper top plates interconnected by upright studs and wherein each wall frame includes a diagonal brace anchored at its upper end to the corresponding top plate and resting at its lower end on said subfloor adjacent the included angle side of the corresponding sole plate, said method including providing an elongated, inclined push stick having upper and lower ends and means on its lower end defining endwise outwardly projecting teeth for non-slip engagement with an penetration of the upper surface of said subfloor, positioning said upper end of said push stick against the top plate of one of said wall frames closely adjacent the other wall frame and with said push stick disposed in a vertical plane substantially normal to said one wall frame and with said teeth engaged with the upper surface of said subfloor at a location spaced along said other wall frame from said one wall frame, applying downward inclined pressure on the longitudinal mid portion of said push stick in a direction toward the sole plate of said one wall frame while maintaining the upper end of said push stick engaged with the top plate of said one wall frame and allowing said teeth to slide over the upper surface of said subfloor until said one wall frame top plate is laterally displaced to a position with said one wall frame vertically disposed, releasing the downward pressure on said longitudinal mid portion of said push stick to allow said teeth to bit into and penetrate the upper surface of said subfloor and thereafter securing the lower end of said diagonal brace of said other wall frame to the sole plate of said other wall frame, removing said push stick from engagement with said one wall frame and said subflooring and engaging the upper end of said push stick with the top plate of said other wall frame adjacent said one wall frame and the teeth of said push stick with said subfloor while said push stick is disposed in a generally vertical plane paralleling said one wall frame, applying a downward inclined force on the longitudinal mid portion of said push stick while the upper end thereof is maintained and engagement with the top plate of said other wall frame to slide said teeth along said upper surface of said subflooring toward said other wall frame until said other wall frame is vertically disposed, releasing said downward pressure on said mid portion of said push stick and thereafter securing the lower end of said inclined brace of said one wall frame to said sole plate of said one wall frame.

* * * * *